United States Patent [19]

Perrella

[11] Patent Number: 4,609,032

[45] Date of Patent: Sep. 2, 1986

[54] NOZZLE ASSEMBLY FOR DIE CASTING MACHINE

[76] Inventor: Guido Perrella, 9 Belvedere Road, Westmount, Quebec, Canada

[21] Appl. No.: 705,941

[22] Filed: Feb. 25, 1985

[30] Foreign Application Priority Data

Feb. 29, 1984 [CA] Canada ..... 448519

[51] Int. Cl.[4] ..... B22D 17/20; B22D 17/30

[52] U.S. Cl. ..... 164/312; 164/337; 164/342; 222/570; 425/DIG. 227

[58] Field of Search ..... 164/303, 306, 312, 316, 164/309, 337, 342, 137; 222/570, 569, 567; 425/DIG. 227

[56] References Cited

U.S. PATENT DOCUMENTS

| | | | |
|---|---|---|---|
| 3,356,130 | 4/1963 | Mellen, Jr. et al. | 164/306 |
| 3,596,708 | 8/1971 | Lapin | 164/343 |
| 3,698,849 | 10/1972 | Czerski | 164/303 |
| 4,013,116 | 3/1977 | Perrella | 164/262 |
| 4,053,271 | 10/1977 | Gellert | 425/DIG. 227 |
| 4,248,289 | 2/1981 | Perrella et al. | 164/153 |
| 4,417,616 | 11/1983 | Seitz | 164/113 |
| 4,423,763 | 1/1984 | Perrella | 164/316 |

FOREIGN PATENT DOCUMENTS

| | | | |
|---|---|---|---|
| 151332 | 5/1953 | Australia | 164/316 |
| 100864 | 1/1980 | Japan | 164/309 |

*Primary Examiner*—Nicholas P. Godici
*Assistant Examiner*—Samuel M. Heinrich
*Attorney, Agent, or Firm*—Beveridge, DeGrandi & Weilacher

[57] ABSTRACT

A nozzle for a die casting machine of the type having mold halves that move toward and away from the parting line and engage a nozzle located on the parting line. The nozzle is free to "float" a limited amount on its surface mounting so as to assume a correct location at every shot in response to the die inserts closing around it. The nozzle also has a frusto-conical surface on the exit end of its aperture to provide a clean breakaway after a shot is made and only a small contact area is provided on the nozzle for engagement by the molds to reduce heat transfer thereto from the nozzle, moreover the structure increases specific superficial pressure between the nozzle area and the mold insert area in order to crush any metal debris that accumulates during the casting operation.

1 Claim, 7 Drawing Figures

NOZZLE ASSEMBLY FOR DIE CASTING MACHINE

This invention relates to die casting and in particular to a nozzle for die casting machines of the balance, dual movement type which incorporates a pair of mold halves which simultaneously are moved towards and away from the parting line thereof.

U.S. Pat. No. 4,248,289 of Feb. 3, 1981 discloses a nozzle configuration for use with a die casting machine of the type described above. In that U.S. Patent, the nozzle incorporates a body portion which is "trapped" by inserts in the mold halves when the molds are closed upon the nozzle assembly prior to a shot therethrough. The nozzle of the present invention provides improvement in this art and is adapted for use with die casting machines of the type shown in U.S. Pat. No. 4,248,289 and in particular for use with compact injection assemblies of the type shown in my copending Canadian application Ser. No. 368,889 filed Jan. 20, 1981.

In die casting machines such as that illustrated in U.S. Pat. No. 4,248,289 which utilize a parting line injection, the entry of the molten casting metal into the die cavity passes through a gooseneck or injection conduit and a nozzle which is centered with the parting line of the molds. It is important to have a fluid tight seal between the nozzle and the die inserts in the mold halves when the mold halves are closed upon the nozzle and it is also important to have freedom of movement between the surfaces of the die inserts and the nozzle when the inserts are pulled away from the nozzle to minimize any dragging or sticking between the two bodies.

While the nozzle shown in U.S. Pat. No. No. 4,248,289 was successful in meeting the above mentioned requirements, the nozzle of the present invention provides important advances in the reduction of mass of the nozzle; a reduction in down time for removing the nozzle from its assembly; and the creation of a definite line of temperature gradiant between the nozzle and the nozzle seat.

According to a broad aspect, a nozzle for injecting molten metal into the cavity of a die casting machine of the type having a pair of mold halves which simultaneously move toward and away from the parting line so as to engage and disengage the nozzle located on the parting line, the nozzle comprises a shell body with a circular shoulder at one end for engagement by clamping means and a rectangular flange at the other end for engagement by insert means in the mold halves.

The invention is illustrated by way of example in the accompanying drawings in which.

Figure 1:
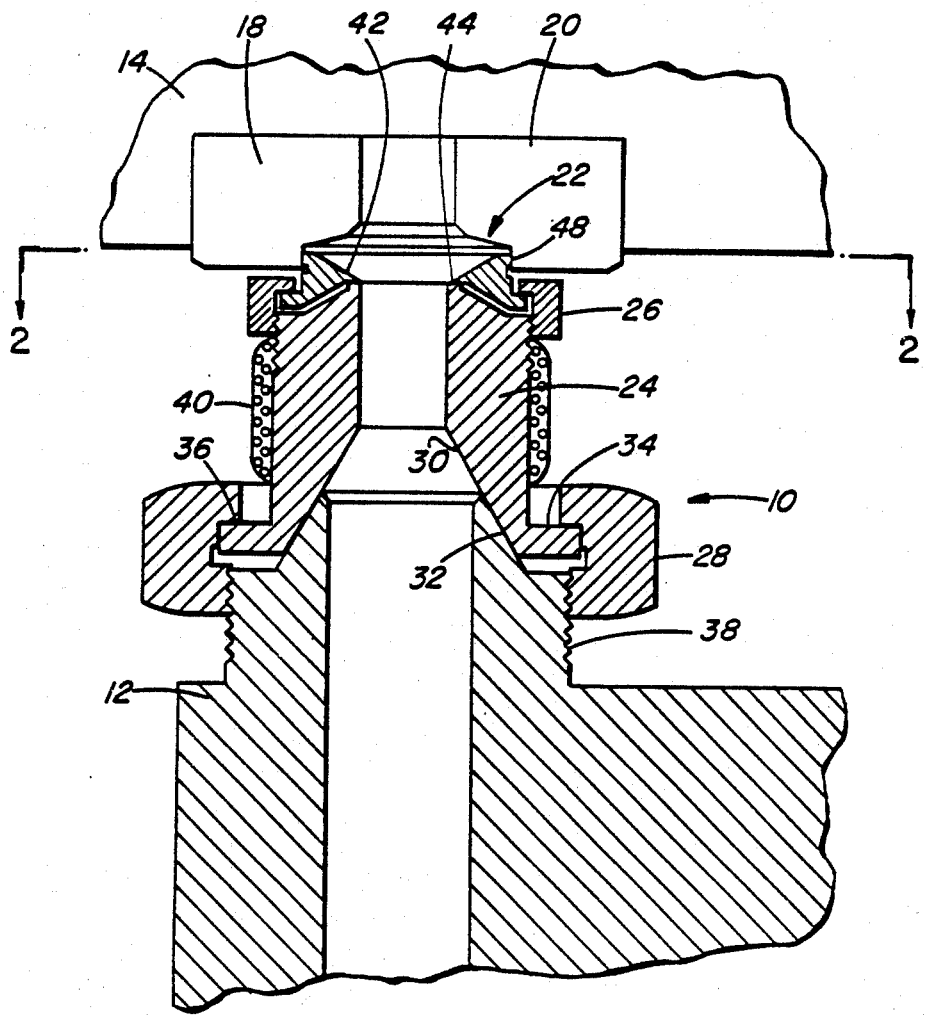
FIG. 1 is cross sectional view of nozzle assembly incorporated in the present invention.
Figure 2:
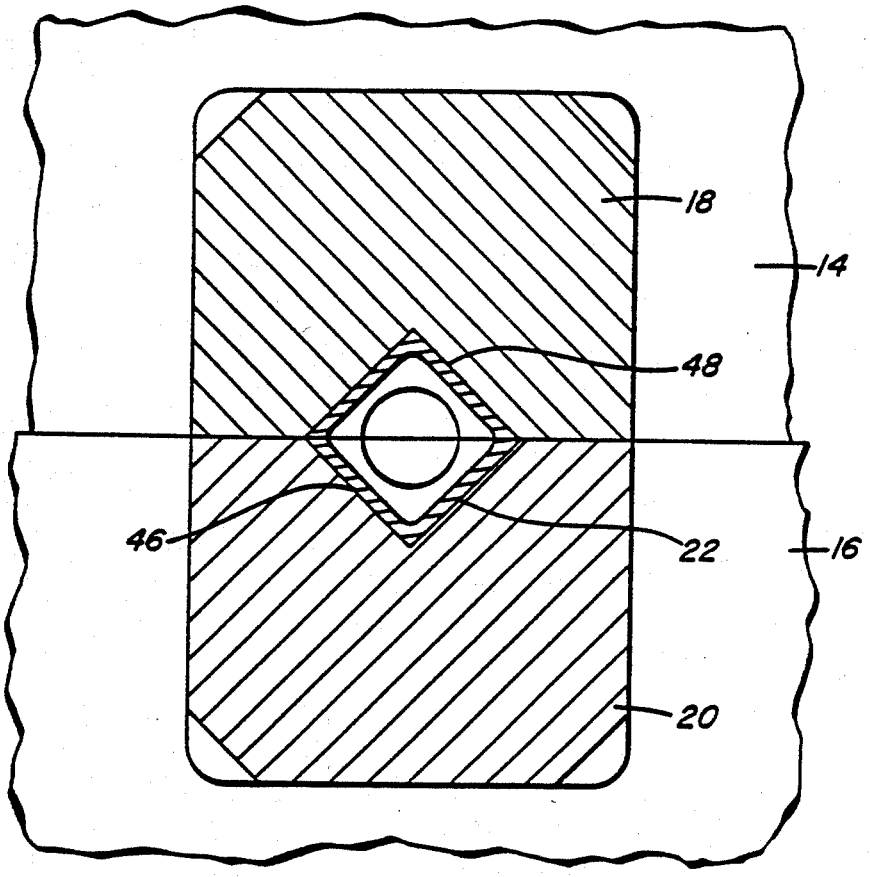
FIG. 2 is an end view of the assembly of FIG. 1.

Referring to FIGS. 1 and 2, a nozzle assembly 10 of a die casting machine is illustrated, the assembly being mounted on a gooseneck or conduit 12 of a die casting machine which includes a pair of mold halves 14,16 that incorporate nozzle clamp die inserts 18 and 20 respectively.

The nozzle, illustrated generally at 22, is secured onto the end of a nozzle adaptor 24 by means of a circular nozzle clamp nut 26, the adaptor 24 being mounted on the terminal end of the gooseneck or conduit 12 by means of a further clamping nut 28. The adaptor 24 has a frusto-conical inner surface 30 which mates with a similar surface 32 on the conduit 12. The adaptor 24 is provided with a flange 34 which is engaged by a shoulder 36 in the clamping nut 28 so as to draw the adaptor 24 downwardly over the end of the conduit 12 when the nut 28 is rotated on the threads 38 of the conduit. A sleeve heater 40 encircles the nozzle adaptor 24 to maintain the desired temperature in the assembly.

Figure 3:
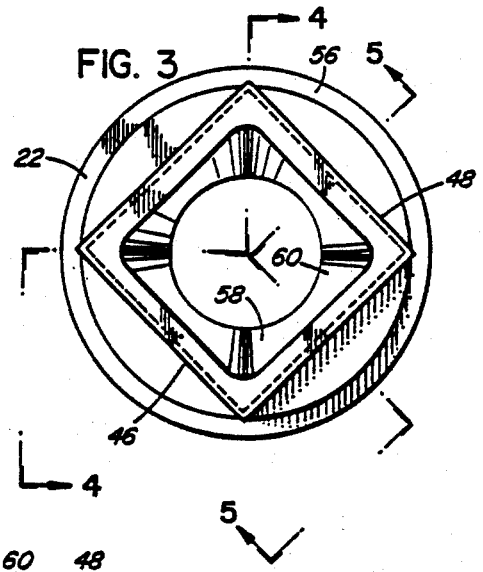
FIG. 3 is an elevation view of the nozzle according to the invention.
Figure 6:
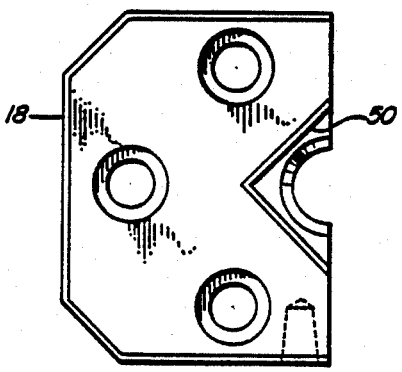
FIGS. 6 and 7 are front and side elevation views respectively of a die insert as shown in FIG. 2.
Figure 7:
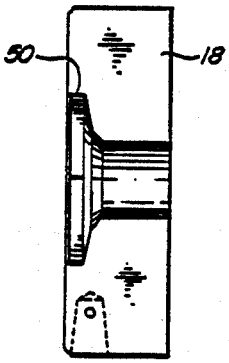

It will be seen from FIG. 1 that the nozzle 22 has a base portion 42 which serves as a seat for the terminal end 44 of the nozzle adaptor 24. It will be appreciated that the surface area of the terminal end 44 is quite small relative to the size of the adaptor and accordingly there is minimal heat transfer between the adaptor 24 and the nozzle 22. Additionally, the nozzle 22 is rectangular in end view as seen in FIGS. 2 and 3 its exit end having a rectangular flange 46 which presents a diamond shaped, narrow contact strip 48 that is engaged by the mating surfaces 50 in the die inserts 18 and 20 as shown in FIG. 6 and 7. This narrow contact strip 48 ensures that a minimal amount of heat will be transferred from the nozzle adaptor 24 and the nozzle 22 (as well as the molten zinc therein) to the die inserts 18 and 20 which are substantially cooler in temperature.

Figure 4:
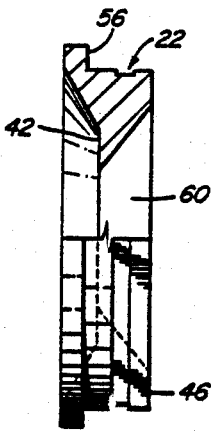
FIG. 4 is a side elevation; partly sectioned as seen from line 4—4 of FIG. 3.
Figure 5:
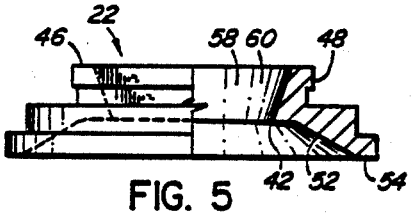
FIG. 5 is another elevation view partly in section as seen from line 5—5 of FIG. 3.

Referring to FIGS. 3, 4 and 5, the entrance end of the nozzle 22 has a wide frusto-conical surface 52 terminating in a rim 54 which is engaged by the clamp nut 26 to secure the nozzle seat 42 on the adaptor 24. The nozzle 22 is held in this position with sufficient circumferential clearance to allow the seat 42 of the nozzle to float on the surface of the adaptor 24 within a given tolerance, say 1/32 inch. The circular shoulder 56 of the rim 54 is engaged by the nozzle clamp nut 26 so that the nozzle 22 can be quickly removed and replaced on the adaptor.

The exit end 58 of the nozzle has a frusto-conical wall 60 which terminates in a small contact area and forms a distinct heat barrier between the nozzle and the contacting surfaces of the mold halves 14, 16.

While the invention has been described in connection with a specific embodiment thereof and in a specific use, various modifications of the invention will occur to those skilled in the art without departing from the spirit and scope of the invention as set forth in the appended claims.

The terms and expressions employed in the specification are used as terms of description and not of limitation. There is no intention in the use of such terms and expressions to exclude any equivalence of the features shown and described or portions thereof and it is recognized that various modifications are possible within the scope of the invention claimed.

The embodiments of the invention in which an exclusive property or privilege is claimed are defined as follows:

1. A nozzle assembly for use in injection molten metal into the cavity of a die casting machine of the type having a pair of mold halves which simultaneously move toward and away from a mold parting line so as to engage and disengage said nozzle assembly located on the parting line;

said nozzle assembly comprising a nozzle and an adaptor for retaining said nozzle on the end of a gooseneck injector means;

said adaptor having an outer terminal end comprising a narrow, raised rim;

said nozzle comprising a shallow body with entrance and exit ends and having wide, frusto-conical entrance and exit surfaces;

said entrance end having a circular shoulder for engagement by adaptor clamping means;

said exit end having a narrow rectangular peripheral rim to present a small contact area of the nozzle to adjacent surfaces of said mold halves;

and said nozzle including a generally centrally located, flat circular seat for engagement with said narrow raised rim of said adaptor;

said seat having a sufficient diameter to provide a horizontal floating area for the nozzle on said adaptor so that said nozzle may assume a correct location at every injection shot in response to inserts closing around said nozzle.

* * * * *